US011780228B2

(12) United States Patent
Min

(10) Patent No.: US 11,780,228 B2
(45) Date of Patent: Oct. 10, 2023

(54) PRINTER

(71) Applicant: KOSTECH, INC., Seoul (KR)

(72) Inventor: Kyung-Won Min, Seoul (KR)

(73) Assignee: KOSTECH, INC., Seoul (KR)

( * ) Notice: Subject to any disclaimer, the term of this patent is extended or adjusted under 35 U.S.C. 154(b) by 152 days.

(21) Appl. No.: 17/434,427

(22) PCT Filed: Nov. 28, 2019

(86) PCT No.: PCT/KR2019/016635
§ 371 (c)(1),
(2) Date: Aug. 27, 2021

(87) PCT Pub. No.: WO2020/175768
PCT Pub. Date: Sep. 3, 2020

(65) Prior Publication Data

US 2022/0143979 A1 May 12, 2022

(30) Foreign Application Priority Data

Feb. 27, 2019 (KR) ..... 10-2019-0023062

(51) Int. Cl.
*B41J 2/165* (2006.01)
*B41J 3/407* (2006.01)
*B41J 2/21* (2006.01)

(52) U.S. Cl.
CPC ..... *B41J 2/16511* (2013.01); *B41J 2/2114* (2013.01); *B41J 2/2117* (2013.01); *B41J 3/4078* (2013.01); *B41J 2/21* (2013.01)

(58) Field of Classification Search
CPC ..... B41J 2/16511; B41J 2/2114; B41J 2/2117; B41J 3/4078; B41J 2/21
See application file for complete search history.

(56) References Cited

U.S. PATENT DOCUMENTS

2008/0016630 A1* 1/2008 Grasselli ..... B41J 2/2114 118/46
2008/0122880 A1 5/2008 Sloan
(Continued)

FOREIGN PATENT DOCUMENTS

CN 102144007 A 8/2011
CN 104512139 A 4/2015
(Continued)

OTHER PUBLICATIONS

Partial Supplementary European Search Report for Corresponding EP Application No. 19916590.3 dated Mar. 25, 2022.
(Continued)

*Primary Examiner* — Sharon Polk
(74) *Attorney, Agent, or Firm* — Renner, Otto, Boisselle & Sklar, LLP

(57) ABSTRACT

A printer according to the present invention includes an ink head unit for spraying ink through a head, and an adhesive head unit for spraying an adhesive material through the head.
Specifically, by including the adhesive head unit configured to spray a plurality of adhesive materials through a plurality of heads, respectively, the present invention enables use of an inkjet type print head in forming patterns on a fiber fabric, paper, a transfer film, or the like, and thus enables various designs and printing on a fiber fabric including a blended fiber fabric; paper; a transfer film; or the like through processing digital type image and data and can ensure excellent print quality, and can enhance the printing speed while achieving easy and convenient printing.

5 Claims, 4 Drawing Sheets

(56) References Cited

U.S. PATENT DOCUMENTS

| | | | |
|---|---|---|---|
| 2011/0164086 | A1 | 7/2011 | Ggoto et al. |
| 2012/0066843 | A1 | 3/2012 | Fukui |
| 2016/0023454 | A1 | 1/2016 | Sloan |
| 2017/0218564 | A1 | 8/2017 | Sloan |
| 2018/0207954 | A1 | 7/2018 | Schiestl |

FOREIGN PATENT DOCUMENTS

| | | | |
|---|---|---|---|
| CN | 106715788 | A | 5/2017 |
| CN | 108025563 | A | 5/2018 |
| JP | H8-039772 | A | 2/1996 |
| JP | H11-188873 | A | 7/1999 |
| JP | 2000-015161 | A | 1/2000 |
| JP | 2007-090554 | A | 4/2007 |
| JP | 2008-132762 | A | 6/2008 |
| JP | 2008-213333 | A | 9/2008 |
| JP | 2009-012382 | A | 1/2009 |
| JP | 2009-051149 | A | 3/2009 |
| JP | 2010-053497 | A | 3/2010 |
| JP | 2010-201781 | A | 9/2010 |
| JP | 2011-005760 | A | 1/2011 |
| JP | 2011-088963 | A | 5/2011 |
| JP | 2011-101973 | A | 5/2011 |
| JP | 2011-121180 | A | 6/2011 |
| JP | 2011-126250 | A | 6/2011 |
| JP | 5740912 | B2 * | 7/2015 |
| KR | 10-0152591 | B1 | 12/1998 |
| KR | 10-1525502 | B1 | 6/2015 |
| KR | 10-2017-0036761 | A | 4/2017 |
| KR | 10-2018-0035230 | A | 4/2018 |
| KR | 10-2018-0039536 | A | 4/2018 |

OTHER PUBLICATIONS

Office Action for corresponding CN Application No. 201980093090.4 dated May 31, 2022.

International Search Report dated Mar. 5, 2020 in International Application No. PCT/KR2019/016635.

Original and English Translation of Japanese Office Action issued for corresponding JP Application No. 2021-550681, dated Jul. 6, 2022.

* cited by examiner

【FIG. 1】
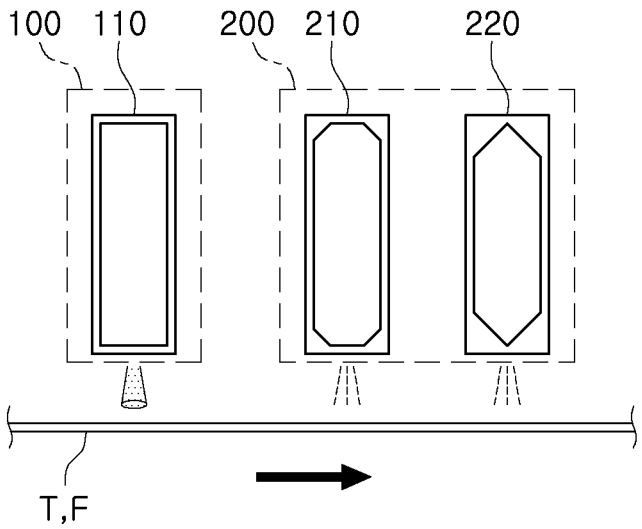
【FIG. 2】
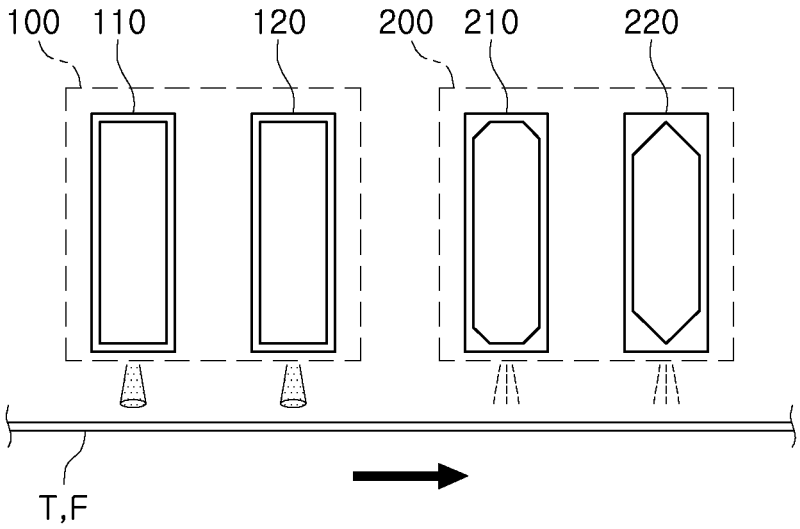

【FIG. 3】
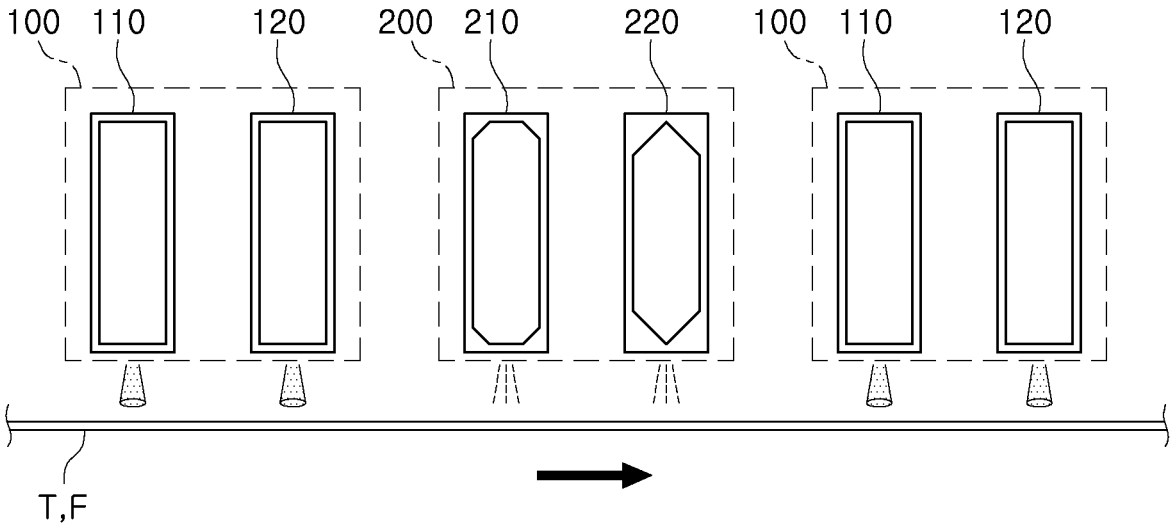
【FIG. 4】
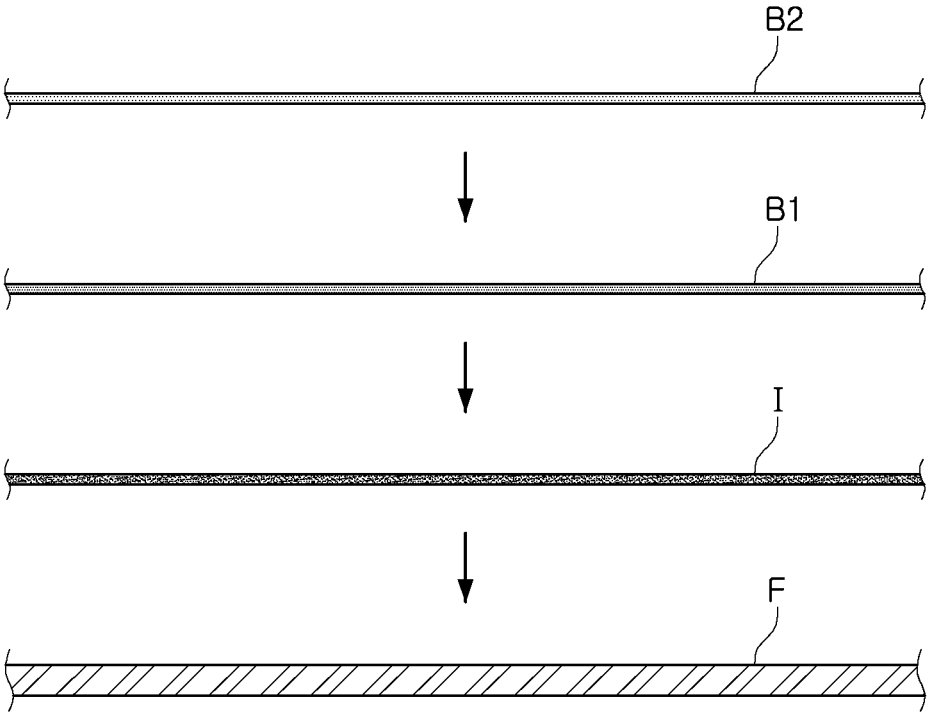

【FIG. 5】
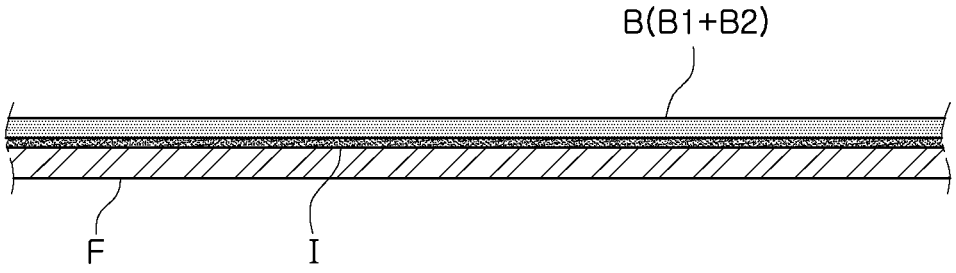
【FIG. 6】
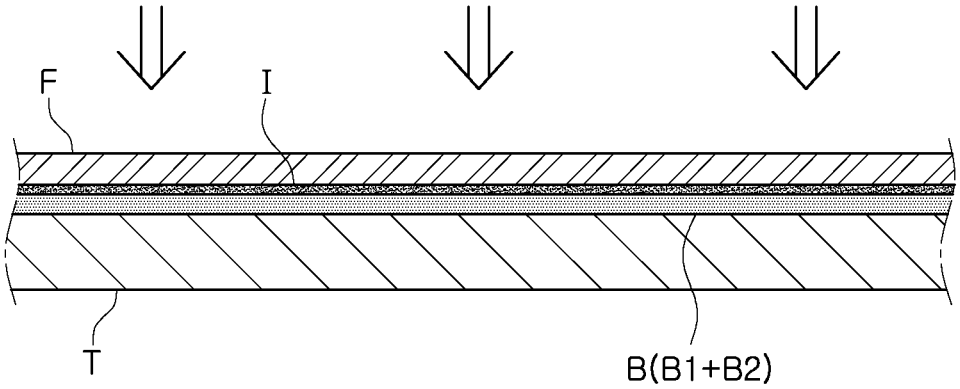
【FIG. 7】
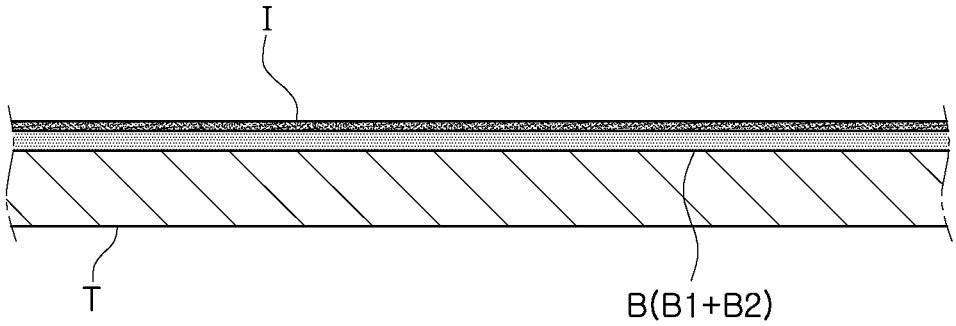

【FIG. 8】
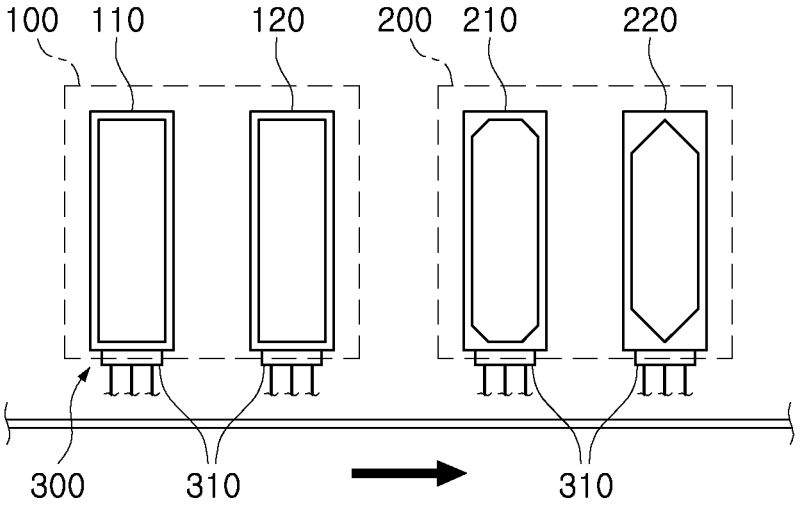
【FIG. 9】
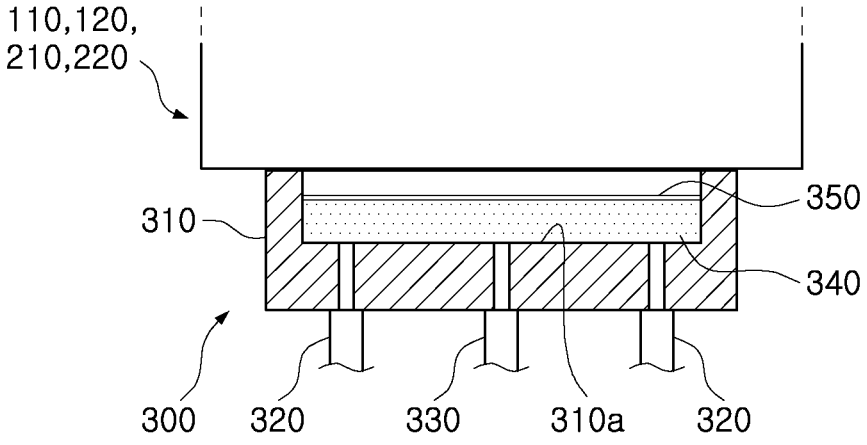

PRINTER

This application is a national phase of International Application No. PCT/KR2019/016635 filed Nov. 28, 2019, which claims priority to Korea, Republic of (KR) Application No. 10-2019-0023062 filed Feb. 27, 2019, the entireties of which are hereby incorporated by reference.

TECHNICAL FIELD

The present disclosure relates to a printer, and more particularly, to a printer for printing on textiles, paper, a transfer film, or the like.

BACKGROUND ART

Generally, a printer may be a device for printing an image such as letters or figures on a material including a paper or textiles.

Various types of printer, such as a plate-making type, a dot type, an inkjet type, or the like, may be applied to a printer depending on a method of printing an image. For example, as for an inkjet printer using an inkjet type printhead, various designs and forms of printing may be available through digital processing of an image and data, such that an inkjet printer has been widely used in diverse fields due to the high degree of usability thereof.

Recently, as digital printing technology has been developed on a daily basis, such a printer has been increasingly used in the textile dyeing industry requiring speed and durability in printers, as well as with paper.

Representative textile dyeing methods include immersion dyeing in which a textile is dyed by immersing the textile in water, printing dyeing by printing an image on the textile, and transfer dyeing in which a design is printed on a specific medium and the design is transferred to the textile.

As for the printing dyeing, which has been the most widely used, a complex dyeing method in which the textile is pretreated, a design is printed on the pretreated textile, the textile goes through a heat treatment at high temperature and humidity and is washed has been used. In the case of sublimation transfer dyeing, one of the transfer dyeing methods deemed a part of the printing dyeing, a design is printed on the paper by various methods using a sublimation transfer dye, and the design printed on the paper is transferred to polyester textile using a high-temperature press to dye the textile.

Recently, as the performance and speed of an inkjet printer have been greatly improved, as one of printing methods in printing dyeing and transfer dyeing, an inkjet printer has been increasingly used as a printer for printing dyeing and transfer dyeing.

Since a design or a printing method are processed digitally in the inkjet printing method, a design or colors may be changed freely, such that small-type mass production or multi-type small-scale production may be processed at high speed, which may be an advantage to increase productivity and added value. Thus, such a method has greatly contributed to the development of the textile dyeing and design industry.

Various types of textiles are present, and since dyeing properties are different depending on textile materials, an ink suitable for the properties of a textile has to be selectively used to obtain good dyeing quality.

For example, generally, a reactive ink may be used for dyeing a vegetable material such as cotton, an acid ink may be used for dyeing an animal material such as silk, and a sublimation transfer ink may be used for synthetic textiles such as polyester.

However, as for a mixed textile in which several materials are mixed, it may be difficult to obtain a good dyeing effect using a certain ink. For example, a reactive ink or a transfer ink may be used for a mixed textile in which a cotton textile is mixed with a synthetic textile, and both inks may not be able to satisfy both textiles at the same time, such that a good dyeing effect may not be obtained.

In particular, in the case of a textile having a high mixing ratio, it may be difficult to obtain a vivid color expression, and the adhesion thereof may also be weak, such that durability may be deteriorated, which may be problematic.

As an alternative to the issues in dyeing such mixed textiles or as a method to obtain a special dyeing effect, a dyeing method in which, after printing a design on a film medium such as an PET, an adhesive may be only applied to the portion on which the design is printed and the design may be attached to the textile using a press such that a dyeing effect may be obtained, has been used.

In this method, the desired pattern may be dyed while maintaining the texture of the textile by only applying the adhesive to the design part, and thus, the dyeing may be performed by applying the adhesive to the design by various methods. As representative methods, two methods have been used, as below.

One of the methods is such, that, while a design is printed on the film using a liquid or gel ink, a powdered adhesive may be applied to the entire film on which the design is printed, the adhesive may be shaken off or blown such that the adhesive may only remain on the wet ink may be used. The other method is that a liquid adhesive may only be applied to a design using a screen-printing method such as a method of printing a design using an ink.

However, since the two methods are not digital methods, there is a limitation in that the advantages of the aforementioned digital method may not be obtained.

DISCLOSURE

Technical Problem

The present disclosure has been devised to address the issues described above, and the purpose thereof is to provide a printer which may digitally print on textiles including a mixed textile and may also maintain excellent printing quality.

Technical Solution

To achieve the purpose as above, a printer includes an ink head unit configured to spray ink through a head; and an adhesive head unit configured to spray an adhesive material through a head.

The adhesive head unit may spray different adhesive materials through a plurality of heads, and a multicomponent adhesive may be formed as the sprayed different adhesive materials are mixed.

The ink head unit may include four primary color heads configured to spray cyan, magenta, yellow, and black, which are four primary colors (CMYK).

The ink head unit may further include a white head configured to spray white (W).

The ink head unit may further include a spot color head configured to spray a spot color other than the four primary colors and white.

The printer may further include a plurality of capping members fastened to each of the head of the ink head unit and the head of the adhesive head unit when a printing operation is paused; an ink suction line connected to the capping member coupled to the head of the ink head unit; and an adhesive material suction line connected to the capping member fastened to each of the plurality of heads of the adhesive head unit, wherein the ink suction line includes an ink suction pump, and wherein a plurality of the adhesive material suction lines are provided to correspond to the plurality of heads of the adhesive head unit, and the plurality of adhesive material suction lines include different adhesive material suction pumps.

Advantageous Effects

The printer according to the present disclosure may include an adhesive head unit configured to spray a plurality of adhesive materials to each of a plurality of heads through a head, such that a design may be formed on textile, a paper, or a transfer film using an inkjet type printhead. Accordingly, the effect that various designs and printings may be printed and applied on textiles including a mixed textile, a paper, or a transfer film through digitally processing an image and data, excellent printing quality may be guaranteed, printing may be conveniently and easily performed, and a printing speed may increase may be obtained.

Also, the printer according to the present disclosure may include a head cleaning unit having a plurality of capping members to be fastened to heads, respectively, when an operation is paused, such that there may be the advantage in which the head provided in each of the ink head unit and the adhesive head unit may be protected and the surface of the spraying portion of the head may be maintained to be clean.

BRIEF DESCRIPTION OF DRAWINGS

FIGS. 1 to 3 are diagrams illustrating an example of printing on a transfer film and textile using a printer according to an example embodiment of the present disclosure;

FIG. 4 is a diagram illustrating an example of printing a design and spraying an adhesive material using a printer according to an example embodiment of the present disclosure;

FIG. 5 is a diagram illustrating an example in which an adhesive layer is formed as a plurality of adhesive material are mixed;

FIG. 6 is a diagram illustrating an example of transferring a design of a transfer film to textile;

FIG. 7 is a diagram illustrating an example in which a transfer film is removed from the textile to which a design is transferred;

FIG. 8 is a diagram illustrating an example in which a capping member, which is a head cleaning unit, is installed each of a head of an ink head unit and a head of an adhesive head unit in the printer illustrated in FIG. 1; and FIG. 9 is an enlarged diagram illustrating an interior of the capping member illustrated in FIG. 8.

BEST MODE FOR INVENTION

Hereinafter, the present disclosure will be described in detail with reference to example drawings. It should be noted that, in adding reference numerals to the components in each drawing, the same components are provided with the same reference numerals even though the components are indicated on different drawings. Also, in describing the present disclosure, when it is determined that a detailed description of a related known configuration or function may obscure the gist of the present disclosure, the detailed description thereof will not be provided.

FIGS. 1 to 3 are diagrams illustrating an example of printing on a transfer film and textile using a printer according to an example embodiment.

Referring to the drawings, the printer according to the present disclosure may include an ink head unit 100 and an adhesive head unit 200.

Here, the ink head unit 100 may be configured to spray ink through a head.

Specifically, the ink head unit 100 may include a four primary color head 110 and a white head 120.

In this case, the four primary color head 110 may spray cyan, magenta, yellow, and black, which are the four primary colors (CMYK) in printing, and accordingly, a design I may be printed on textile T, which is a printing object, in various colors, or the design I may be formed on a transfer film F, which is an intermediate medium.

Also, the white head 120 illustrated in FIGS. 2 and 3 may spray white (W), and may be configured to print white on the textile T, which is a printing object, as a background color.

Further, a plurality of the ink head units 100 may be provided, as disposed on the front and rear sides of the adhesive head unit in FIG. 3.

Although not illustrated in the drawings, the ink head unit 100 may further include a spot color head (not illustrated) for spraying a spot color other than the four primary colors and white.

In this case, the spot color may be one of colors such as orange, blue, green, gray (Lk, LLk, etc.), red, a fluorescent color, and the like, and a plurality of the spot color heads may be provided in the ink head unit 100.

The adhesive head unit 200 may be configured to spray the adhesive material through a head.

Specifically, the adhesive head 200 may spray different adhesive materials through the plurality of heads, and the sprayed different adhesive materials may be mixed to form a multicomponent adhesive.

Generally, it may be difficult to spray an adhesive for attaching textiles by an inkjet printhead, or even when it is possible to spray the adhesive, the adhesive may be easily cured (solidified) such that a nozzle of an expensive printhead may easily be clogged, which may cause breakage of the expensive printhead.

Accordingly, a one-component adhesive may not be used as an adhesive sprayed through the printhead. In other words, the one-component adhesive may be hardened in the nozzle of the printhead when being cured, such that the nozzle may be easily clogged.

The address the issue above, in the present disclosure, a multicomponent adhesive may be used as an adhesive sprayed through the printhead. In other words, the multicomponent adhesive may be obtained by mixing two or more types of raw materials.

As a specific example, the adhesive head unit 200 may include a first adhesive material head 210 and a second adhesive material head 220 to obtain a two-component adhesive.

Here, the first adhesive material head 210 may spray the first adhesive material, and for example, the first adhesive material may be resin.

Also, the second adhesive material head 220 may spray the second adhesive material, and for example, the second adhesive material may be a curing agent, and the curing agent sprayed as above may be mixed with the resin sprayed before the curing agent, thereby finally obtaining an adhesive.

The adhesive head unit 200 may further include a plurality of heads to obtain a multicomponent adhesive, such as a three-component adhesive or a four-component adhesive.

As described above, the printer according to the present disclosure may include the ink head unit 100 and also the adhesive head unit 200 configured to spray an adhesive material through the head, such that the design I may be formed on textile, a paper, or a transfer film using an inkjet type printhead, and accordingly, the effect that various designs and printings may be printed and applied on the textile T or the transfer film F, which is an intermediate medium, using the printhead by an inkjet method, various designs and printings may be printed and applied on the textile T including a mixed textile through digitally processing an image and data, excellent printing quality may be guaranteed, printing may be conveniently and easily performed, and a printing speed may increase.

Furthermore, the printer according to the present disclosure may be used for various printing objects such as paper in addition to textile and a transfer film.

Meanwhile, the process of printing the textile T using the printer according to the present disclosure will be described with reference to FIGS. 4 to 7.

FIG. 4 is a diagram illustrating an example of printing a design and spraying an adhesive material using a printer according to an example embodiment. FIG. 5 is a diagram illustrating an example in which an adhesive layer is formed as a plurality of adhesive material are mixed. FIG. 6 is a diagram illustrating an example of transferring a design of a transfer film to textile. FIG. 7 is a diagram illustrating an example in which a transfer film is removed from the textile to which a design is transferred.

In printing the textile T using the printer according to the present disclosure, as an example, the printing may be performed using the transfer film F, which is an intermediate medium in the printing, rather than directly printing the textile T, as below.

First, as illustrated in FIG. 4, the ink head unit 100 may spray ink through the head to form a design I on the transfer film F, and the adhesive head unit 200 may spray the first adhesive material B1 and the second adhesive material B2, such that, as illustrated in FIG. 5, the sprayed first adhesive material B1 and the second adhesive material B2 may be mixed and an adhesive layer B, an adhesive, may be formed.

Thereafter, as illustrated in FIG. 6, by turning the transfer film F over and allowing the film to be in contact with the textile T, which is a printing object, and the transfer film F may be pressed using a press device, such that the design I formed on the transfer film F may be adhered to the textile T by the adhesive layer B, and the design I may be finally transferred to the textile T as illustrated in FIG. 7.

FIG. 8 is a diagram illustrating an example in which a capping member, a head cleaning unit, is installed each of a head of an ink head unit and a head of an adhesive head unit in the printer illustrated in FIG. 1. FIG. 9 is an enlarged diagram illustrating an interior of the capping member illustrated in FIG. 8.

Referring to the drawings, the printer according to the present disclosure further may include a head cleaning unit 300.

The head cleaning unit 300 may be provided to protect the head provided in each of the ink head unit 100 and the adhesive head unit 200 and to maintain the surface of a spraying portion of the head to be clean.

Specifically, the head cleaning unit 300 may include a capping member 310 and a suction line 320.

Here, a plurality of the capping member 310 may be provided to be fastened to each of the head of the ink head unit 100 and the head of the adhesive head unit 200 when the printing operation is paused, and may clean each of the plurality of heads.

Here, as for the capping member 310, any general capping element may be used, and as an example, the capping member 310 may have a structure as illustrated in FIG. 9.

In this case, preferably, the capping member 310 may be formed of a rubber material to reduce impacts when connected to the head.

The capping member 310 may include a capping groove 310*a* formed on an upper portion in contact with the head, and the suction line 320 may be connected to be connected to the capping groove 310*a*.

Also, the capping groove 310*a* of the capping member 310 may be filled with a buffer member 340 such as a sponge, and a support mesh 350 may be installed on an upper surface of the buffer member 340.

The suction line 320 may clean the head by suctioning the residual ink or the residual adhesive material remaining on a lower end of the head.

A plurality of the suction line 320 may be provided such that the materials to be suctioned may not be multicomponent, and different suction lines may be connected to different capping members.

Specifically, an ink suction line may be connected to the capping member 310 fastened to the head of the ink head unit 100 (in FIG. 1), and the residual ink in the head of the ink head unit 100 may be suctioned and removed, such that the head of the ink head unit 100 may be cleaned.

Also, the adhesive material suction line may be connected to the capping member 310 fastened to each of the plurality of heads of the adhesive head unit 200 (in FIG. 1), and may suction and remove the residual adhesive material in the head of the adhesive head unit 200, such that the head of the adhesive head unit 200 may be cleaned.

More specifically, a plurality of the adhesive material suction lines may be provided to correspond to the plurality of heads of the adhesive head unit, and to prevent the suctioned adhesive materials from being mixed, different adhesive material suction lines may be connected to different capping members 310 fastened to the plurality of heads of the adhesive head unit 200.

Further, to prevent the suctioned materials from being mixed, the ink suction line may include an ink suction pump (not illustrated), and the plurality of adhesive material suction lines may include different adhesive material suction pumps (not illustrated).

In this case, in the case in which the plurality of adhesive material suction lines are not provided independently to correspond to the capping members 310, or do not have separate suction pumps, the adhesive materials may be mixed and an adhesive may be formed such that the suction line may be clogged and the suction pump may be broken.

An air supply line 330 may be connected to be connected to the capping groove 310*a* of the capping member 310.

The air supply line 330 may supply air to allow the interior space of the capping groove 310*a* in which pressure has become negative due to air suction by the suction line 320, to be equalized to atmospheric pressure, such that, when the capping member 310 is separated from the head, negative pressure shock may not be applied to the head.

Accordingly, the printer according to the present disclosure may include the adhesive head unit 200 configured to spray the plurality of adhesive materials to each of the plurality of heads through the head, such that the design I may be formed on the textile T, a paper, or a transfer film using an inkjet type printhead, and accordingly, various designs and printings may be printed and applied on textile including a mixed textile, a paper, or a transfer film through digitally processing an image and data, excellent printing quality may be guaranteed, printing may be conveniently and easily performed, and a printing speed may increase.

Also, the printer according to the present disclosure may include the head cleaning unit 300 including the plurality of capping members 310 to be fastened to heads, respectively, when an operation is paused, such that the head provided in each of the ink head unit 100 and the adhesive head unit 200 may be protected and the surface of the spraying portion of the head may be maintained clean.

While the example embodiments have been illustrated and described above, it will be apparent to those skilled in the art that modifications and variations could be made without departing from the scope of the present disclosure as defined by the appended claims.

The invention claimed is:

1. A printer, comprising:

an ink head unit configured to spray ink through a head; and an adhesive head unit configured to spray an adhesive material through a head, wherein the adhesive head unit sprays different adhesive materials through a plurality of heads, and a multicomponent adhesive is formed as the sprayed different adhesive materials are mixed.

2. The printer of claim 1, wherein the ink head unit includes four primary color heads configured to spray cyan, magenta, yellow, and black, which are four primary colors (CMYK).

3. The printer of claim 2, wherein the ink head unit further includes a white head configured to spray white (W).

4. The printer of claim 2, wherein the ink head unit further includes a spot color head configured to spray a spot color other than the four primary colors and white.

5. The printer of claim 1, further comprising:

a plurality of capping members fastened to each of the head of the ink head unit and the head of the adhesive head unit when a printing operation is paused;

an ink suction line connected to the capping member coupled to the head of the ink head unit; and an adhesive material suction line connected to the capping member fastened to each of the plurality of heads of the adhesive head unit, wherein the ink suction line includes an ink suction pump, and wherein a plurality of the adhesive material suction lines are provided to correspond to the plurality of heads of the adhesive head unit, and the plurality of adhesive material suction lines include different adhesive material suction pumps.

* * * * *